US006302051B1

(12) United States Patent
Hemmingson

(10) Patent No.: US 6,302,051 B1
(45) Date of Patent: Oct. 16, 2001

(54) TRANSOM TRUNK

(76) Inventor: Rick H. Hemmingson, 3619 - 20th Crescent, Vernon, British Columbia (CA), V1T 1G2

( * ) Notice: Subject to any disclaimer, the term of this patent is extended or adjusted under 35 U.S.C. 154(b) by 0 days.

(21) Appl. No.: 09/613,842

(22) Filed: Jul. 11, 2000

Related U.S. Application Data

(63) Continuation-in-part of application No. 09/127,957, filed on Aug. 3, 1998, now Pat. No. 6,085,686.
(60) Provisional application No. 60/054,705, filed on Aug. 4, 1997.

(51) Int. Cl.[7] ..... B63B 8/00
(52) U.S. Cl. ..... 114/343; 224/406
(58) Field of Search ..... 114/343, 364, 114/362; 224/406, 511, 537; 410/77, 90

(56) References Cited

U.S. PATENT DOCUMENTS 4,805,859 2/1989 Hudson .
5,050,526 9/1991 Nelson et al. .
5,240,214 * 8/1993 Birnbaum et al. ..... 248/231.4

* cited by examiner

*Primary Examiner*—Ed Swinehart
(74) *Attorney, Agent, or Firm*—Reidlaw, L.L.C.; John S. Reid

(57) ABSTRACT

A container and container mounting apparatus for releasably securable mounting of the container onto a generally horizontal rigid platform on a boat, where the platform is adjacent and aft of a transom on the boat, includes a container sized to stably rest, adjacent the transom on the generally horizontal rigid platform, a female receiver rail mountable to the platform, and a male coupling rail. The male coupling rail is mounted or mountable to a lower surface of the container along a rail axis. The male coupling rail is for sliding interlocking into along the female receiver rail when the female receive rail is mounted to the platform and the male coupling rail is mounted to the lower surface of the container.

26 Claims, 4 Drawing Sheets

TRANSOM TRUNK

CROSS REFERENCE TO RELATED APPLICATION

This application is a Continuation-In-Part application from U.S. patent. application Ser. No. 09/127,957 filed Aug. 3, 1998 now U.S. Pat. No. 6,085,686 entitled Transom Trunk which claims benefits of 60,054,705 filed Aug. 4, 1997

FIELD OF THE INVENTION

This invention relates to method of releasably securing coolers, or locker for power boats, and particular, to portable storage onto the swim grid or platform of power boats.

BACKGROUND OF THE INVENTION

The transom trunk of the present invention is intended to satisfy two needs: i) the overall shortage of secure and weatherproof storage recreational boats including so-called run-abouts, ski-boats and cruisers; and ii) to provide a place to land and store fish in those same recreational boats and cruisers given the widespread trend toward better interior boat finishes and materials—one of which are designed to accommodate fishing without risk of stains, permanent odors and damage to the interior.

Those who wish to spend some time fishing must usually choose either a more expensive full fiberglass interior option with or without snap-in carpet or buy a boat outfitted for fishing (e.g. live wells, bait wells, fiberglass lined in-floor storage, etc.). The first option is expensive and the latter option means that comfortable tasteful interior design, seating and materials which are intended to accommodate cruising, skiing, family boating and camping are mostly sacrificed.

In the prior art, Applicant is aware of U.S. Pat. No. 4,805,859 which issued Feb. 21, 1989 to Hudson for an Apparatus for Securing Containers to Moving Platforms. Hudson discloses anchoring a tackle box to a boat by means of a frame upon which are two parallel interlocking rails which mate with corresponding interlocking grooves provided within the tackle box or within an attachment affixed to tackle box's exterior surface. Applicant is also aware of U.S. Pat. No. 5,050,526 which issued Sep. 24, 1991 to Nelson for a Boat Attachment. Nelson teaches an elongated container having a cross section of the approximate cross section of a fishing boat wherein the container has a plurality of straps attached to each end of the elongated container. The straps are adapted, by means of hook brackets, for mounting over each side of the boat gunnel. What is neither taught nor suggested, and that which it is an object of the present invention to provide, is mounting a container onto the aft transom swim platform of, for example, a pleasure boat by using a rail and track system where several rails, secured to the underside of the storage container, can be slidably mated with several relatively short tracks secured to the swim platform of a boat without the need to vertically raise the storage container to engage the rails and tracks. Further, use of the swim platform when the storage container is removed is not impeded since the short tracks are spaced apart, can be manufactured from softer plastic material and are contoured to eliminate sharp edges in a 'foot friend manner'. The short tracks of the present invention allow the storage container to be aligned with the swim platform mounted rails with minimal lateral offset requiring only minimal movement for full engagement, a decided advantage when mounting a fully packed container. A single locking lever which is accessible to either the finger or toe of a boater secures the storage container and permits easy removal by a single person.

SUMMARY OF THE INVENTION

The transom trunk to the present invention may be described as a container and container mounting apparatus for releasably securable mounting of the container onto a generally horizontal rigid platform on a boat, such as swim platform, where the platform is adjacent and aft of a transom on the boat. The container and container mounting apparatus includes a container, sized to stably rest adjacent the transom on the generally horizontal rigid platform, and fasteners, for releasably securable mounting of the container to the transom. The storage container fasteners include first elongate members secured to the underside of the storage container extending parallel to the longitudinal sides of the container mating with second members secured to the swim platform positioned for sliding engagement with the first members.

In summary, the container and container mounting apparatus of the present invention for releasably securable mounting of the container onto a generally horizontal rigid platform on a boat, where the platform is adjacent and aft of a transom on the boat, includes a container sized to stably rest, adjacent the transom on the general horizontal rigid platform, a female receiver rail mountable to the platform, and a male coupling rail. The male coupling rail is mounted or mountable to a lower surface of the container along a rail axis. The male coupling rail is for sliding interlocking into and along the female receiver rail when the female receive rail is mounting to the platform and the male coupling rail is mounted to the lower surface of the container.

The female receiver rail has a first length, which is less than, for example one half, the length of a corresponding dimension of the container along the rail axis. The male coupling rail has a length which without intending to be limiting, may be the same as the length of the female rail. The male rail is coaxial with the rail axis when the male coupling rail is interlockingly coupled with the female receiver rail.

To use the rails for mounting the container onto the platform, the male coupling rail is offset along the rail axis by a distance at least equal to the first length that is, it is offset the length of the female rail so as to engage or disengage the male coupling rail from the female receiver rail. This avoids having to cantilever the container off the edge of the platform by, for example, any more than one half the length of the container when engaging or disengaging the male and female rails, thus minimizing the amount of bending overboard of user mounting or dismounting the container from the platform. Thus the first length may be less than half the length of the corresponding dimension of the container. In another embodiment the first length is less than one third the length of the corresponding dimension of the container. The shorter the first length, the less the container has to be cantilevered overboard to mount or dismount the container from the platform. However, if the first length is too short, the container may not be securely mounted to the platform. That is, in rough weather a too short female rail may deform and release the male rail.

Advantageously the upper surface of female receiver rails are bevelled to remove sharp protrusions or projecting sharp edges.

In preferred embodiment the rail axis is a lateral axis of the platform extending laterally across the platform behind and substantially parallel to the transom.

The container mounting apparatus of the present invention may also include a second male coupling rail mounted or mountable to the lower surface of the surface of the parallel to and spaced a first distance form the first male coupling rail. It will also then include a second female receiver rail mountable to the platform parallel to and spaced the first distance from the first female receiver rail when mounted to the platform.

The first and second male coupling rails may be substantially identical and mounted or mountable in spaced apart side-by-side relation on the lower surface of the container. The first and second female receiving rails may be substantially identical and mountable in spaced apart side-by-side relation on the platform for co-operative sliding mating with the first and second male coupling rails respectively.

In one aspect of the present invention the first and second male coupling rails are mounted or mountable at a first end of the lower surface of the container and the first and second female receiver rails are mountable to a first side of the platform offset from a centerline of the boat. A third rail may be mountable to the platform on a second side of the platform, opposite to the first side, for supporting a second end of the container opposite the first end. Alternatively the third rail may be mounted or mountable to the lower surface of the container on a second end of the container opposite the first for supporting the second end of the container on the platform.

A fastening means is provided for releasably securing the trunk onto the swim platform. In one embodiment a spring-loaded latch having a locking tab is provided for releasbly locking the male end female rails to each other when fully mated.

In another embodiment, where the rail axis is parallel to the heel of the boat, the trunk or rails on the trunk may also be releasably fastened to the boat by a rigid or flexible member, such as an arm or strap, attached to the ski tow eye on the boat's transom.

DETAILED DESCRIPTION OF PREFERRED EMBODIMENTS

Figure 1:
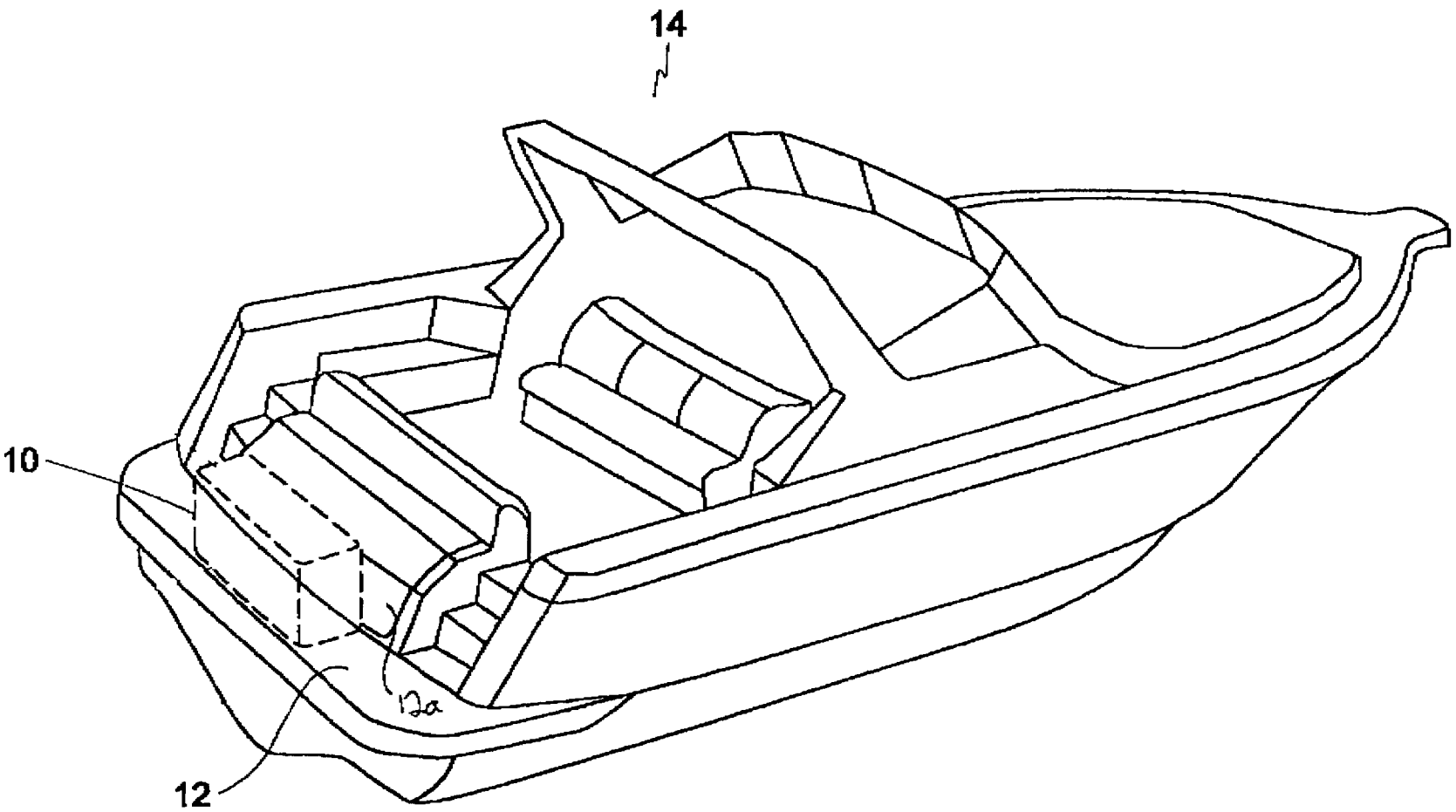
FIG. 1 is, in perspective view, a conventional boat having mounted thereon, and shown in dotted outline, the transom truck of the present invention.
Figure 2:
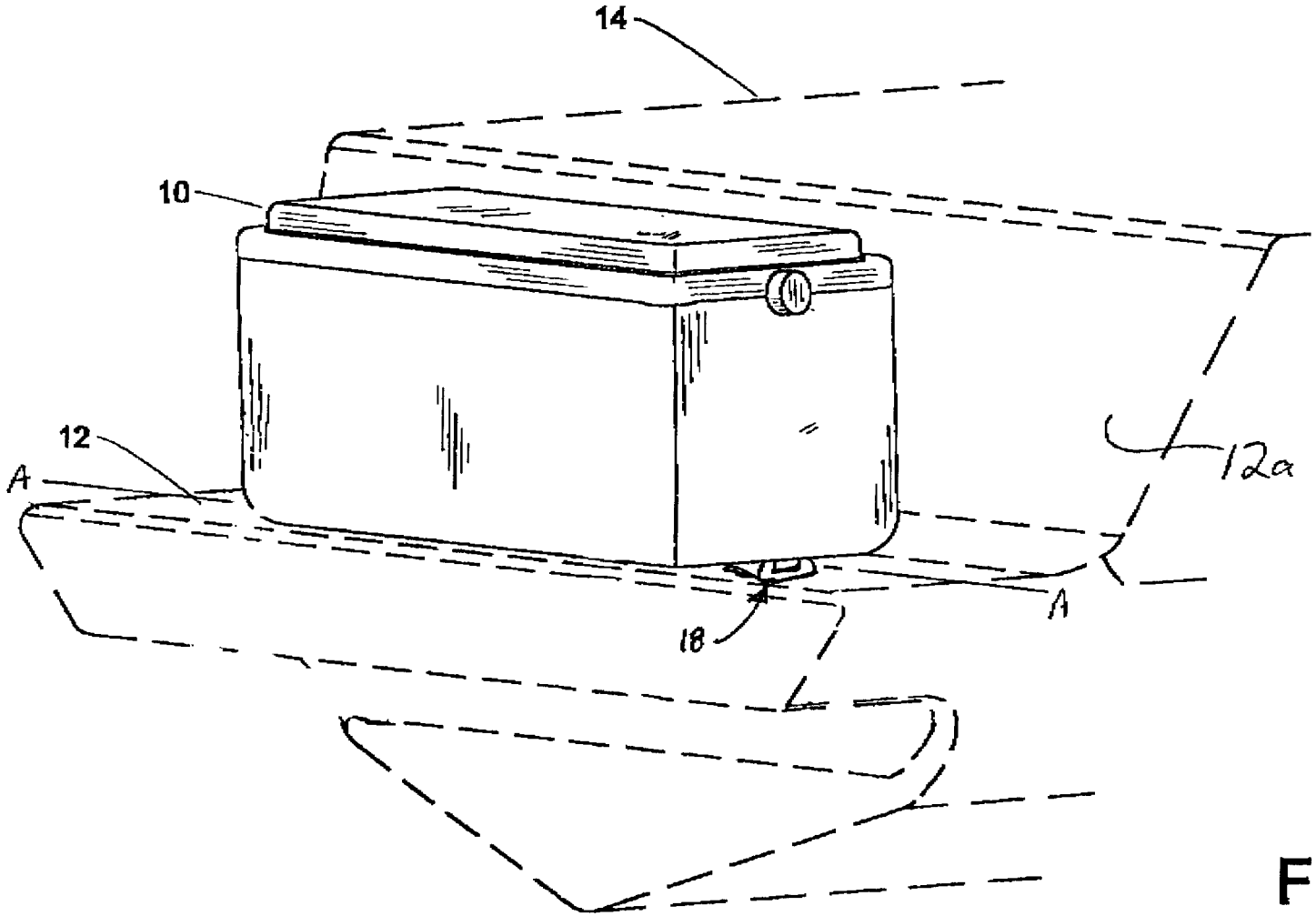
FIG. 2 is, in rear perspective view, the transom trunk of the present invention mounted onto a swim platform.
Figure 3:
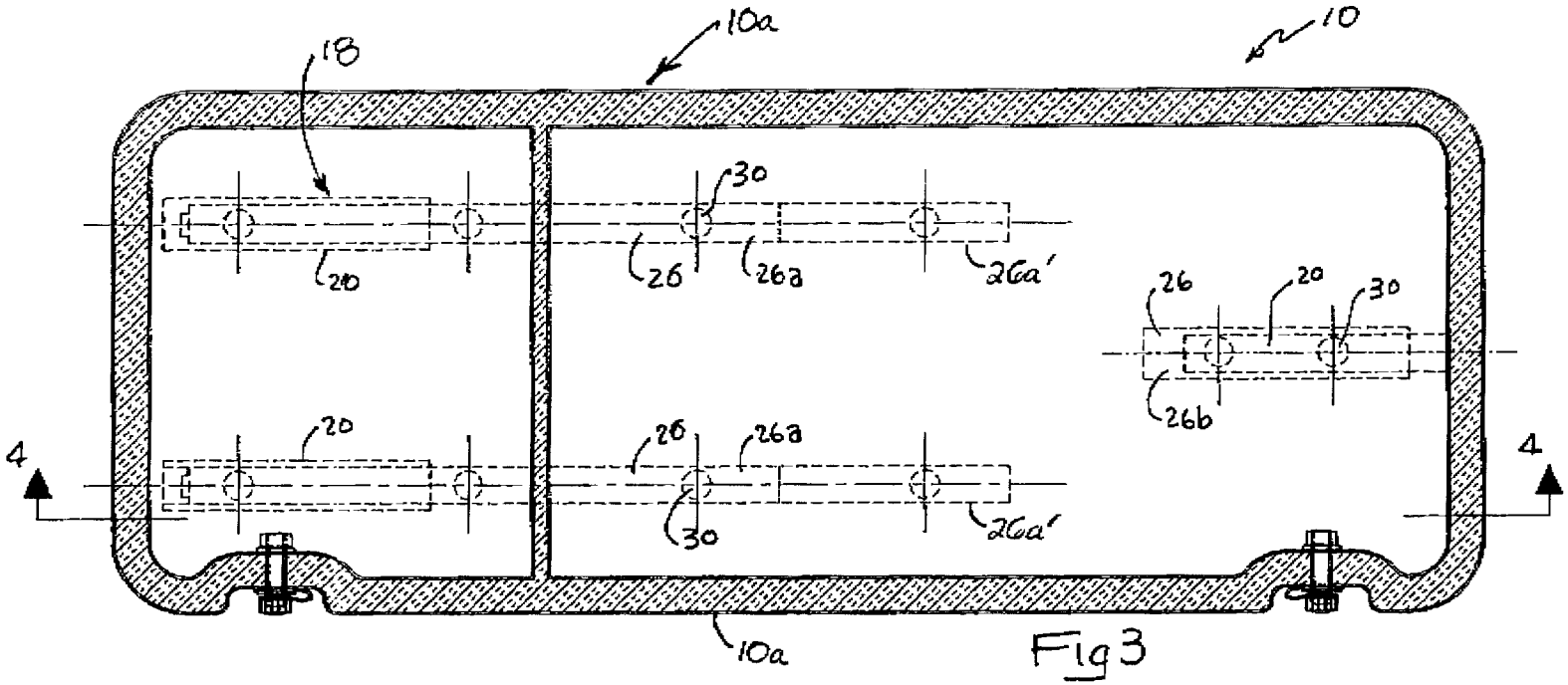
FIG. 3 is a plan view of the transom truck of the present invention.
Figure 4:
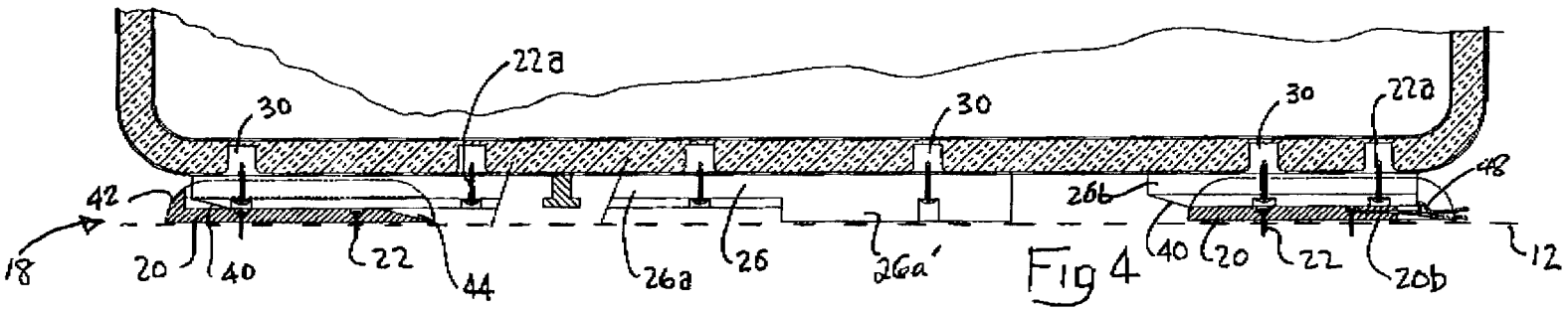
FIG. 4 is a sectional view taken on line 4—4 of FIG 3.
Figure 5:
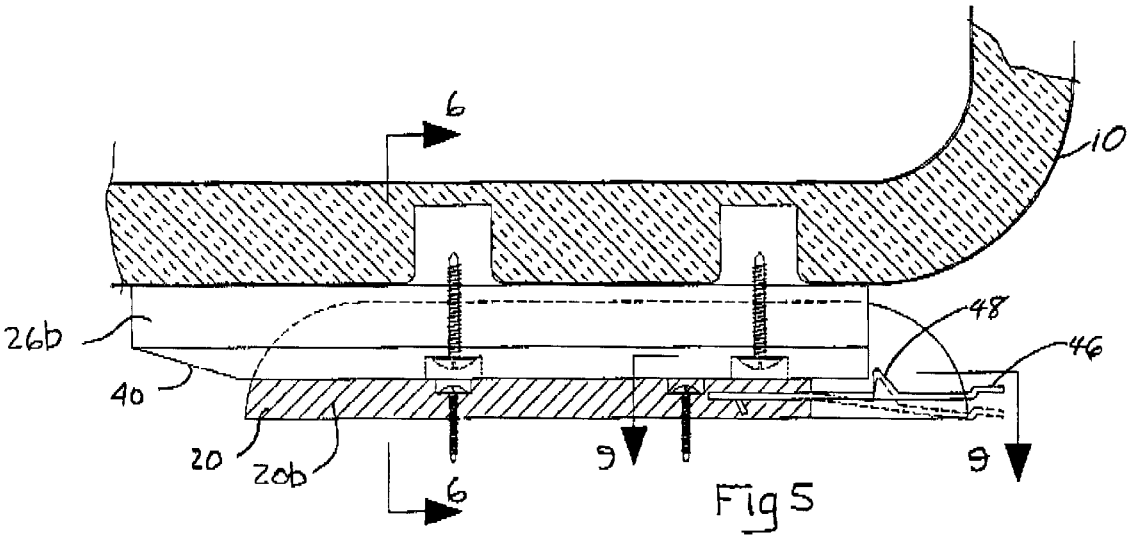
FIG. 5 is an enlarged sectional view of a portion of FIG 4.
Figure 6:
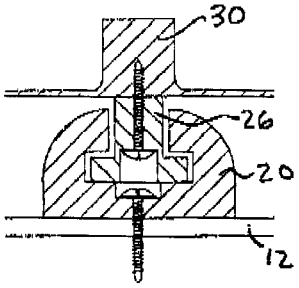
FIG. 6 is a sectional view taken on line 6—6 of FIG 5.
Figure 7:
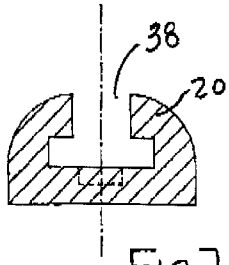
FIG. 7 is a cross-sectional view of the track portion of the connector.
Figure 8:
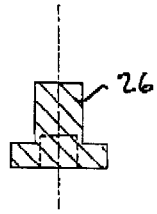
FIG. 8 is a cross-sectional view of the rail portion of the connector.
Figure 9:
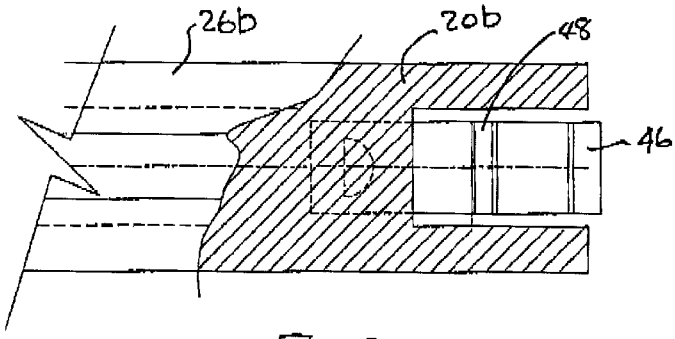
FIG. 9 is a sectional view taken on line 9—9 of FIG. 5.

As illustrated in FIGS. 1–9, the transom trunk of the present invention is a removable trunk 10 removably securable to a swim platform 12. Swim platform 12 is common to many modern boats 14 and protrudes or is cantilevered so as to extend horizontally aft of the upper boat transom 14*a*. Trunk 10 is releasable fastened to swim platform by means of a rail and track system 18.

The track and rail system 18 consists of several female receiver rails or track members which are secured to the swim platform 12 by conventional means such as screws 22, and corresponding elongate male coupling rail members 26. Rails 26 may also be secured to the underside to the trunk 10 by screws 22*a* along rail axis A. Trunk 10 has formed internally of the bottom wall 28 thickened areas 30 into which screws 22*a* may be threaded.

Rail 26 include long rails 26*a* and a short rail 26*b*. A pair of long rails 26*a* are mounted near end of trunk 10 and extend toward the transverse mid line to trunk 10 generally parallel to the longitudinal sides 10*a* of the trunk. Short rail 26*b* is located near the opposite end of the trunk 10, and is positioned intermediated long rails 26*a*. Rails 26 are tee shaped in cross section. The forward ends of the rails 26 have sloped faces 40 which permit the rails to smoothly enter tracks 20 without the need for manual elevation of the trunk from the swim platform.

Tracks 20 may be formed from a resilient plastic or other material that will be slightly resilient so as to have a 'foot friendly' feel when accidentally kicked by persons walking on the swim platform when the trunk is not in place. To substantially reduce the possibility of injury under these conditions, tracks 20 advantageously have all exposed corners and ends rounded. Tracks 20 have a longitudinally extending T-shaped channel 38 which corresponds in cross sectional shape to that of rails 26. The end of tracks 20 which initially engage sloped faces 40 on rails 26 have an upwardly sloped face 44 which, as corresponding rails 26 are slid into engagement, assist with elevating and aligning rails 26 with channels 38. The opposite ends of tracks 20 have stops 42 to prevent long tracks 26*a* from sliding though channel 38 past the stops.

Track 20*b* corresponds to short rail 26*b*. Track 20*b* has a spring clip 46. Spring clip 46 has a projection 48 is resiliently urged upwardly by the spring clip so as to snap in behind short rail 26*b* as rails 26 fully mate with tracks 20, that is as rails 26*a* engage stops 42, so as to prevent the trunk from sliding relative to the swim platform.

Long rails 26*a* may have rails supports 26*a* which firmly contact the swim platform and thereby provide stability to the trunk when rails 26 are mated into tracks 20.

As will be apparent to those skilled in the art in the light of the forgoing disclosure, many alterations and modifications are possible in the practice of this invention without departing from the spirit or scope thereof. Accordingly, the scope of the invention is to be construed in accordance with the substance defined by the following claims.

What is claimed is:

1. A container and container mounting apparatus for releasably securable mounting of said container onto a generally horizontal rigid platform on a boat, where said platform is adjacent and aft of a transom on said boat, said container and container mounting apparatus comprising:

(a) a container sized to stably rest, adjacent said transom on side generally horizontal rigid platform, (b) a female receiver rail mountable to said platform, (c) a male coupling rail mountable to a lower surface of said container along a rail axis, said male coupling rail for sliding interlocking into and along said female receiver rail when said female receiver rail is mounted to said platform and said male coupling rail is mounted to said lower surface of said container, wherein said female receiver rail is a first length, said first length less than the length of a corresponding dimension of said container along said rail axis, when said female receiver rail is mounted to said platform and said male coupling rail is mounted to said lower surface of said container, and wherein said male said male coupling rail is a second length and coaxial with said rail axis when side male coupling rail is interlocking coupled with said female receiver rail, and wherein to use said rails for mounting said container onto said platform said male coupling rail is offset along said rail axis by a distance at least equal to said first length, whereby said container need only be offset relative to said platform by said length of said corresponding dimension of said container in order to engage or disengage said male coupling rail from said female receiver rail.

2. The device of claim 1 wherein said second length is generally equal to said first length.

3. The device of claim 1 wherein said first length is less than half said length of said corresponding dimension of said container.

4. The device of claim 1 wherein said first length is less than one third said length said corresponding dimension of said container.

5. The device of claim 1 wherein an upper surface of said female receiver rail is bevelled to remove sharp protrusions or projecting sharp edges thereform.

6. The device of claim 1 wherein said rail axis is a lateral axis of said platform extending laterally across said platform behind and substantially parallel to said transom.

7. The device of claim 1, wherein said male coupling rail is a first male coupling rail and wherein said female receiver rail is a first female receiver rail, and further comprising a second male coupling rail mountable to said lower surface of said container parallel to and spaced a first distance from said first male coupling rail when mounted to said container and a second female receiver rail mountable to said platform parallel to and spaced said first distance from said first female receiver rail when mounted said platform.

8. The device of claim 7 wherein said first and second male coupling rails are substantially identical and mountable in spaced apart said-by-said relation on said lower surface of said container.

9. The device of claim 8 wherein said first and second female receiver rails are substantially identical and mountable in spaced apart side-by-said relation on said platform for co-operative sliding mating with said first and second male coupling rails respectively.

10. The device of claim 9 wherein said first second male coupling rails are mountable at a first end of said lower surface of said container and wherein said first and second female receiver rails are mountable to a first side of said platform offset from a centerline of said boat.

11. The device of claim 10 further comprising a third rail mountable to said platform on a second side of said platform, opposite of said first side, for supporting a second end of said container opposite said first end.

12. The device of claim 10 further comprising a third rail mountable to said lower surface on a second end of said container opposite said first end for supporting said second end of said container on said platform.

13. The container and container mounting apparatus for releasably securable mounting of said container onto a generally horizontal rigid platform on a boat, where said platform is adjacent and aft of a transom on said boat, said container and container mounting apparatus comprising:

(a) a container sized to stably rest, adjacent said transom on said generally horizontal rigid platform, (b) a female receiver rail mountable to said platform, (c) a male coupling rail mounted to a lower surface of said container along a rail axis, said male coupling rail for sliding interlocking into and along said female receiver rail when said female receiver rail is mounted to said platform, (d) wherein said female receives rail is a first length, said first length less than the length of a corresponding dimension of said container along said rail axis, when said female receiver rail is mounted to said platform and said male coupling rail is mounted to said lower surface of said container, and wherein said male coupling rail is a second length and coaxial with said rail axis when said male coupling rail is interlockingly coupled with said female receiver rail, and wherein to use said rails for mounting said container onto said platform said male coupling rail is offset along said rail axis by a distance at least equal to said first length, whereby said container need only be offset relative to said platform by said length of said corresponding dimension of said container in order to engage or disengage said male coupling rail from said female receiver rail.

14. The device of claim 13 wherein said second length is generally equal to said first length.

15. The device of claim 13 wherein said first length is less than half said length of said corresponding dimension of said container.

16. The device of claim 13 wherein said first length is less than one third said length of said corresponding dimension of said container.

17. The device of claim 13 wherein an upper surface of said female receiver rail is bevelled to remove sharp protrusions or projecting sharp edges thereform.

18. The device of claim 13 wherein said rail axis is a lateral axis of said platform extending laterally across said platform behind and substantially parallel to said transom.

19. The device of claim 13, wherein said male coupling rail is a first male coupling rail and wherein said female receiver rail is a first female receiver rail, and further comprising a second male coupling rail mounted to said lower surface of said container parallel to and spaced a first distance from said first male coupling rail and a second female receiver rail mountable to said platform parallel to and spaced said first distance from said first female receiver rail when mounted said platform.

20. The device of claim 19 wherein said first and second male coupling rails are substantially identical and mounted in space apart side-by-side relation on said lower surface of said container.

21. The device of claim 20 wherein said first and second female receiver rails are substantially identical and mountable in spaced apart side-by-side relation on said platform for co-operative sliding rating with said first second male coupling rails respectively.

22. The device of claim 21 wherein said first and second male coupling rails are mountable at a first end of said lower surface of said container and wherein said first sand second female receiver rail are mounted a first side of said platform offset from a centerline of said boat.

23. The device of claim 22 further comprising a third rail mountable to said platform on a second side of said platform, opposite to said first side, for supporting a second end of said container opposite said first end.

24. The device of claim 22 further comprising a third rail mounted to said lower surface on a second end of said container opposite said first end for supporting said second end of said container on said platform.

25. The device of claim 1 further comprising locking means for releasably locking said container relative to said platform when said male coupling rail is mounted to said female receiver rail.

26. The device of claim 13 further comprising locking means for releasably locking said container relative to said platform when said male coupling rail is mounted to said female receiver rail.

* * * * *